US010283893B2

(12) United States Patent
Wu et al.

(10) Patent No.: US 10,283,893 B2
(45) Date of Patent: May 7, 2019

(54) ELECTRICAL PLUG DEVICE

(71) Applicant: CONNTEK INTEGRATED SOLUTIONS INC., Franklin, WI (US)

(72) Inventors: Jui-Hsiung Wu, Taipei (TW); Chunxi Ju, Taipei (TW); Qing Fu, Taipei (TW)

(73) Assignee: CONNTEK INTEGRATED SOLUTIONS INC., Franklin, WI (US)

( * ) Notice: Subject to any disclaimer, the term of this patent is extended or adjusted under 35 U.S.C. 154(b) by 0 days.

(21) Appl. No.: 15/894,851

(22) Filed: Feb. 12, 2018

(65) Prior Publication Data

US 2019/0058277 A1 Feb. 21, 2019

(30) Foreign Application Priority Data

Aug. 16, 2017 (CN) ..... 2017 1 0702241

(51) Int. Cl.

| | |
|---|---|
| ***H01R 13/44*** | (2006.01) |
| ***H01R 13/631*** | (2006.01) |
| ***H01R 13/08*** | (2006.01) |
| ***H01R 13/506*** | (2006.01) |
| ***H01R 35/04*** | (2006.01) |

(52) U.S. Cl.

CPC ..... *H01R 13/44* (2013.01); *H01R 13/08* (2013.01); *H01R 13/506* (2013.01); *H01R 13/631* (2013.01); *H01R 35/04* (2013.01)

(58) Field of Classification Search

CPC ..... H01R 13/44; H01R 13/631; H01R 13/08; H01R 13/506; H01R 35/04; H01R 23/025

USPC ..... 439/131

See application file for complete search history.

(56) References Cited

U.S. PATENT DOCUMENTS

| | | | | |
|---|---|---|---|---|
| 6,939,150 | B1 * | 9/2005 | Lanni | H01R 35/04 439/131 |
| 7,001,196 | B1 * | 2/2006 | Huang | H01R 35/04 439/131 |
| 7,125,266 | B1 * | 10/2006 | Huang | H01R 35/04 439/131 |
| 7,798,825 | B1 * | 9/2010 | Pai | H01R 31/06 439/131 |
| 8,888,513 | B2 * | 11/2014 | Shi | H01R 31/06 439/131 |
| 2010/0117597 | A1 * | 5/2010 | Wang | H02J 7/0042 320/111 |
| 2013/0237073 | A1 * | 9/2013 | Hsu | H01R 31/065 439/131 |
| 2013/0288493 | A1 * | 10/2013 | Shi | H01R 13/44 439/131 |

(Continued)

*Primary Examiner* — Gary F Paumen

(74) *Attorney, Agent, or Firm* — Hamre, Schumann, Mueller & Larson, P.C.

(57) ABSTRACT

An electrical plug device includes a housing, a cover unit mounted to the housing and a plug module mounted to the cover unit. The housing includes a base wall, a slot forming wall peripherally extending from the base wall, an engaging-groove forming wall peripherally extending from the base wall and opposite to the slot forming wall, and at least one slot formed in the slot forming wall and extending to and meeting the base wall. The plug module extends into the housing and includes a plug member fixed to the cover unit by a fixing unit. The plug member includes at least one plug prong that is movably disposed in the at least one slot to pivot between a folded position and an unfolded position.

13 Claims, 5 Drawing Sheets

(56) References Cited

U.S. PATENT DOCUMENTS

| | | | | |
|---|---|---|---|---|
| 2013/0323947 | A1* | 12/2013 | Lee | H01R 31/06<br>439/131 |
| 2014/0073153 | A1* | 3/2014 | Pai | H01R 13/71<br>439/131 |
| 2014/0199865 | A1* | 7/2014 | De Iuliis | H01R 31/065<br>439/131 |
| 2015/0118873 | A1* | 4/2015 | Loh | H01R 24/66<br>439/131 |
| 2016/0134070 | A1* | 5/2016 | Toh | H01R 24/68<br>439/131 |

* cited by examiner

ELECTRICAL PLUG DEVICE

CROSS-REFERENCE TO RELATED APPLICATION

This application claims priority of Chinese Invention Patent Application No. 201710702241.4, filed on Aug. 16, 2017.

FIELD

The disclosure relates to an electrical plug device, and more particularly to an electrical plug device having at least one plug prong that extends along a direction perpendicular to a direction of mounting of a cover unit to a housing in an unfolded position.

BACKGROUND

A conventional foldable electrical plug device generally includes top and bottom housing walls, and plug prongs disposed within a space defined by these walls. The plug prongs can be folded at about a 90 degree angle when plugged into a plug socket, and in this folded position, the plug prongs extend along a direction parallel to a direction along which the top and bottom housing walls are assembled together. However, when a user intends to remove the foldable electrical plug device from the plug socket, the user will apply a force in a direction parallel to the direction of assembling of the top and bottom housing walls. With that in mind, if the user grips the electrical plug device at an improper place, the top and bottom housing walls could be disassembled unintentionally. Thus, the conventional electrical plug device lacks the structural stability to be convenient for practical uses.

SUMMARY

Therefore, an object of the disclosure is to provide an electrical plug device that can alleviate at least one of the drawbacks of the prior art.

According to the disclosure, the electrical plug device includes a housing, a cover unit and a plug module.

The housing includes a base wall, a slot forming wall peripherally extending from the base wall, an engaging-groove forming wall peripherally extending from the base wall and opposite to the slot forming wall, a pair of opposite side walls peripherally extending from the base wall and each bridging the slot forming wall and the engaging-groove forming wall, and at least one slot formed in the slot forming wall and extending to and meeting the base wall. The slot forming wall, the engaging-groove forming wall and the side walls cooperatively define a receiving space that is in spatial communication with the at least one slot and that has an opening opposite to the base wall.

The cover unit is mounted on the housing and covers the opening.

The plug module is mounted to the cover unit, extends into the housing and is received in the receiving space. The plug module includes a fixing unit mounted to the cover unit, and a plug member that is fixed to the cover unit by the fixing unit and that includes at least one plug prong movably disposed in the at least one slot to pivot between a folded position, where the at least one plug prong lies in the at least one slot and has one end extending toward the base wall, and an unfolded position, where the at least one plug prong protrudes out of the at least one slot and is inclined with respect to the slot forming wall.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
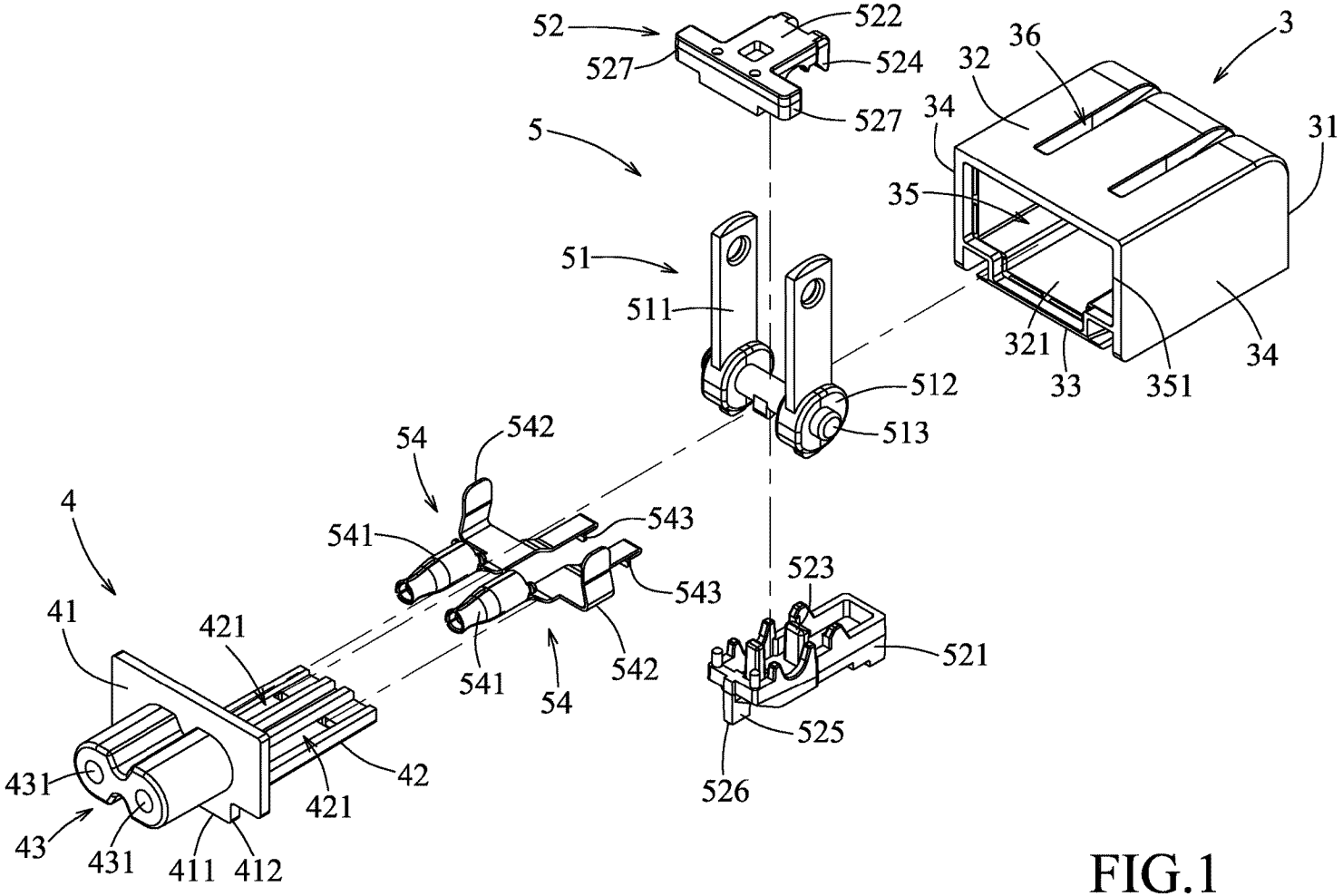
FIG. 1 is an exploded perspective view illustrating an embodiment of an electrical plug device according to the disclosure.
Figure 2:
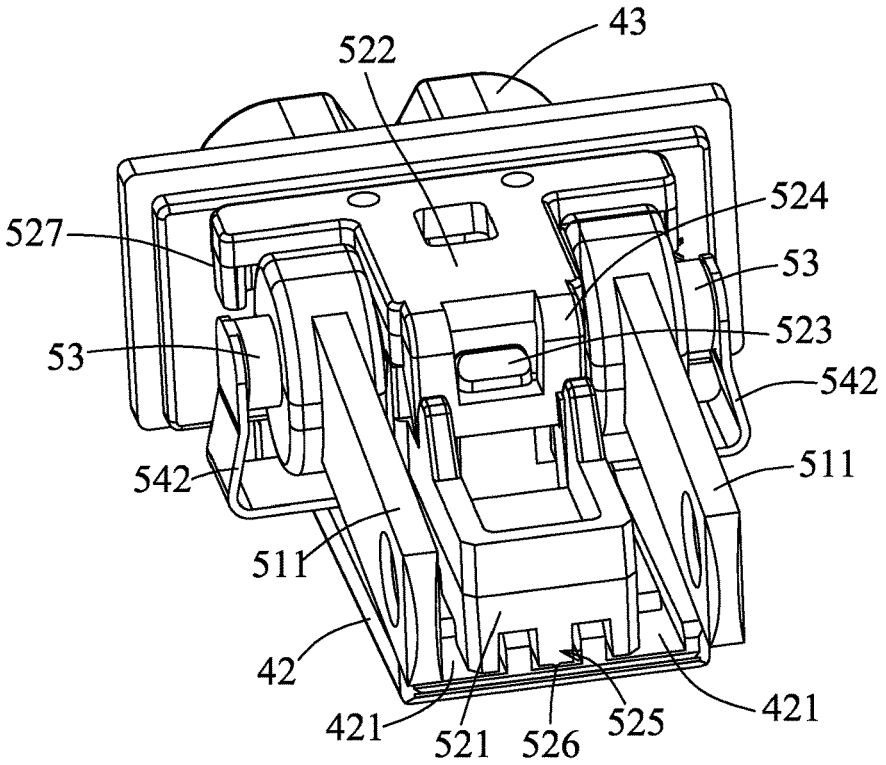
FIG. 2 is a perspective view illustrating an assembled configuration of a plug module and a cover unit of the embodiment.
Figure 3:
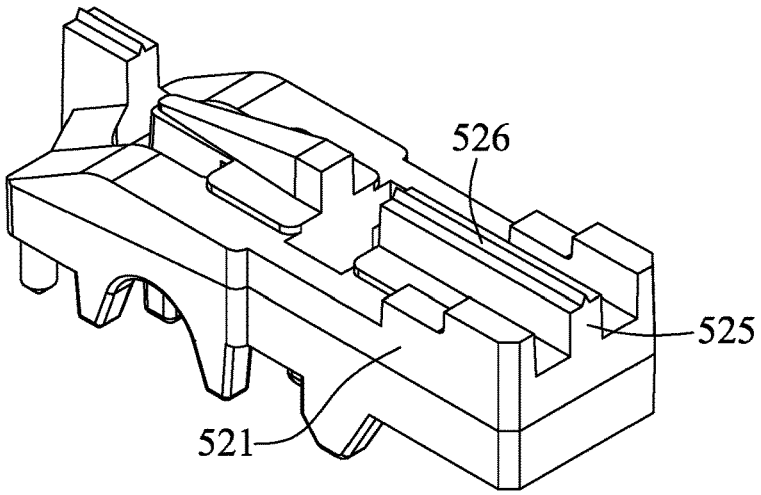
FIG. 3 is a perspective view illustrating a fixing unit of the plug module of the embodiment having a first positioning part formed with a first ultrasonic welding line.

Referring to FIGS. 1 to 3, an embodiment of the electrical plug device of this disclosure includes a housing 3, a cover unit 4, and a plug module 5.

The housing 3 includes a base wall 31, a slot forming wall 32 which peripherally extends from the base wall 31, an engaging-groove forming wall 33 which peripherally extends from the base wall 31 and opposite to the slot forming wall 32, a pair of opposite side walls 34 which peripherally extend from the base wall 31 and each of which bridges the slot forming wall 32 and the engaging-groove forming wall 33, and at least one slot 36 which is formed in the slot forming wall 32 and which extends to and meets the base wall 31. The slot forming wall 32, the engaging-groove forming wall 33, and the side walls 34 cooperatively define a receiving space 35 that is in spatial communication with the at least one slot 36 and that has an opening 351 opposite to the base wall 31.

In this embodiment, for instance, the base wall 31 may have a quadrilateral shape, and the base wall 31, the slot forming wall 32, the engaging-groove forming wall 33 and the opposite side walls 34 may be integrally formed as a single piece structure. A junction between the base wall 31 and the slot forming wall 32 may form a rounded corner. In this embodiment, the housing 3 has two of the slots 36 spaced apart from each other.

The cover unit 4 is mounted on the housing 3 and covers the opening 351 of the receiving space 35 of the housing 3. Specifically, the cover unit 4 includes a base plate 41 that covers the opening 351, a tongue plate 42 that extends from the base plate 41 into the receiving space 35, and a guide portion 43 that extends from the base plate 41 in a direction away from the receiving space 35. The engaging-groove forming wall 33 of the housing 3 is formed with an engaging groove 321 engaged with the tongue plate 42. In this embodiment, the engaging-groove forming wall 33 is exemplified to extend along a direction from the opening 351 of the receiving space 35 to the base wall 31. The tongue plate 42 is formed with at least one guide groove 421. In this embodiment, the tongue plate 42 is exemplified to have two of the guide grooves 421 spaced apart from each other. The guide portion 43 is formed with at least one through hole 431. In this embodiment, the guide portion 43 is exemplified to have two of the through holes 431 spaced apart from each other.

The plug module 5 is mounted to the cover unit 4, extends into the housing 3 and is received in the receiving space 35. Furthermore, the plug module 5 includes a fixing unit 52 that is mounted to the covering unit 4, and a plug member 51 that is fixed to the cover unit 4 by the fixing unit 52. The plug member 51 includes at least one plug prong 511. In this embodiment, the plug member 51 is exemplified to have two of the plug prongs 511. Each of the plug prongs 511 is movably disposed in a corresponding one of the spaced-apart slots 36 to pivot between a folded position (see FIG. 5) and an unfolded position (see FIG. 6). The plug member 51 further includes a plug prong support 512 that is connected the plug prongs 511.

The fixing unit 52 includes a first positioning part 521 and a second positioning part 522 that interlocks with the first positioning part 521. The plug prong support 512 is rotatably disposed between the first positioning part 521 and the second positioning part 522. In this embodiment, the first positioning part 521 has a first hook portion 523 and the second positioning part 522 has a second hook portion 524 interlocking with the first hook portion 523. The first positioning part 521 further includes an engaging portion 525 that is engaged between the spaced-apart guide grooves 421. The engaging portion 525 is formed with a first ultrasonic welding line 526 and is welded to the tongue plate 42 between the guide grooves 421 to increase bonding strength between the engaging portion 525 and the tongue plate 42. Likewise, the base plate 41 has a flange portion 411 that is formed with a second ultrasonic welding line 412 and is welded to the engaging-groove forming wall 33.

The plug member 51 further includes at least one terminal 513 that protrudes from the plug prong support 512 and that is electrically connected to the at least one plug prong 511, at least one conductor element 54 that is electrically connected to the at least one terminal 513 of the plug member 51 and that extends through the cover unit 4. In this embodiment, the plug member 51 is exemplified to have two of the terminals 513 that respectively protrude from two opposite ends of the plug prong support 512 and that is electrically connected to the spaced-apart prongs 511, and two of the conductor elements 54 that are respectively connected to the terminals 513 of the plug member 51. Each of the conductor elements 54 includes a tubular portion 541 that is guided by a corresponding one of the guide grooves 421 to extend into a corresponding one of the through holes 431 of the guiding portion 43 through the base plate 41, a conductive plate 542 that extends from the tubular portion 541 and electrically connected to a corresponding one of the terminals 513, and a barb portion 543 that is connected to the conductive plate 542 and engaged with the tongue plate 42 of the cover unit 4.

The number of the at least one slot 36, the at least one guiding groove 421, the at least one through hole 431, the at least one terminal 513, and the at least one conductor element 54 may be varied in accordance with the number of the plug prongs 511.

Figure 4:
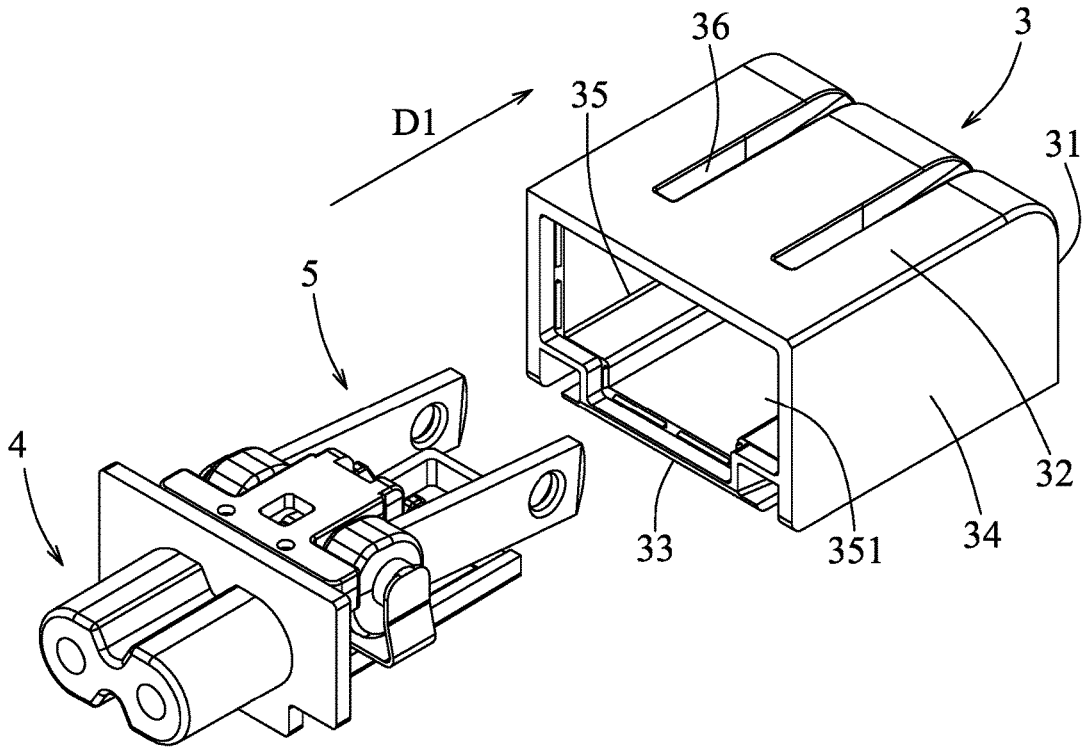
FIG. 4 is a perspective view illustrating a mount direction along which the plug module and the cover unit are mounted to the housing.
Figure 5:
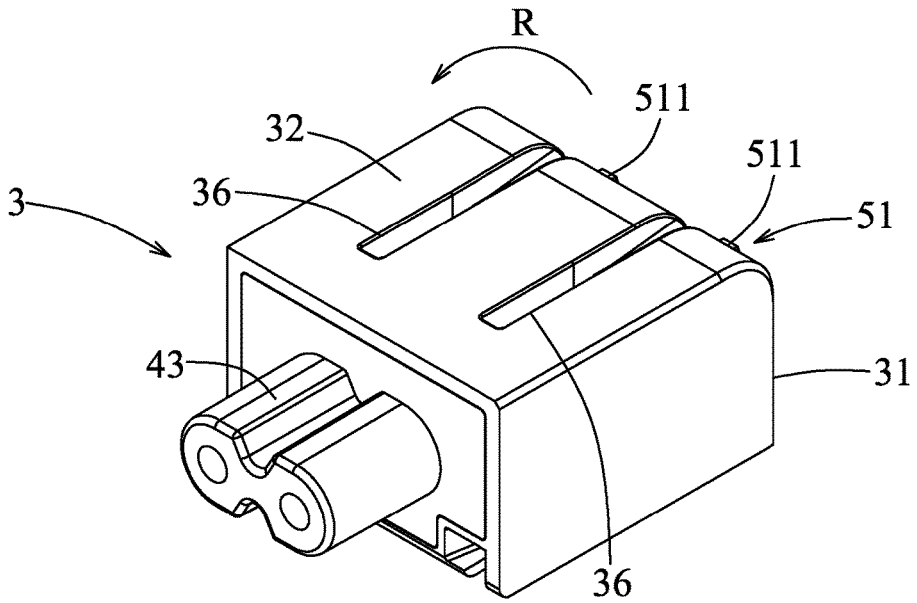
FIG. 5 is a perspective view illustrating plug prongs of a plug member of the plug module of the embodiment in a folded position.
Figure 6:
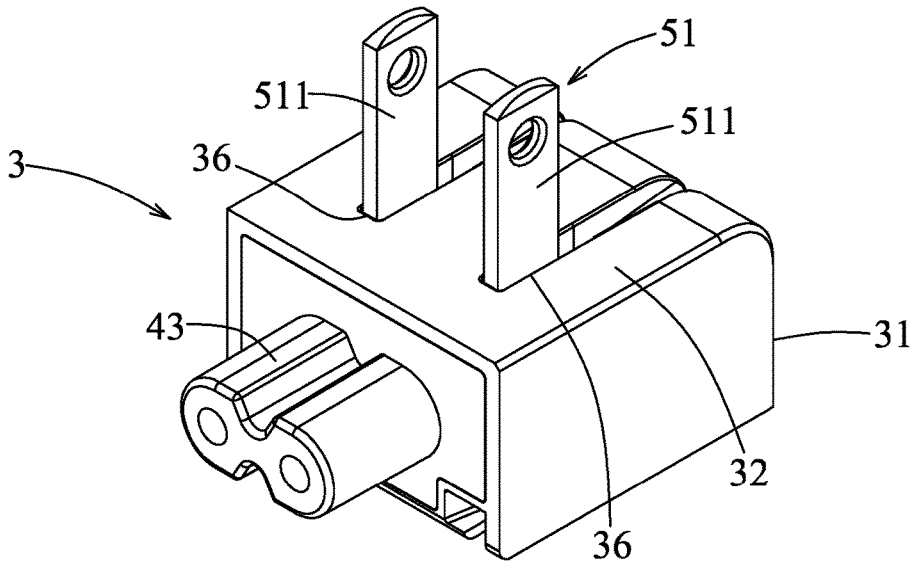
FIG. 6 is a perspective view illustrating the plug prongs of the plug member of the plug module of the embodiment in an unfolded position.

Referring to FIGS. 4 to 6, when the electrical plug device of the disclosure is assembled, the cover unit 4, in conjunction with the plug module 5, is moved toward the opening 351 of the receiving space 35 along the mount direction (D1). Then, the opening 351 is covered with the cover unit 4 and the plug module 5 is received in the receiving space 35. After the above assemblage is completed, each of the plug prongs 511 of the plug member 51 of the plug module 5 is disposed in a corresponding one of the slots 36 and is pivotable between the folded position as shown in FIG. 5 and the unfolded position as shown in FIG. 6. Specifically, referring back to FIG. 5, when the plug prongs 511 are in the folded position, the plug prongs 511 lie in the slots 36. Each of the plug prongs has one end that extends toward the base wall 31 and may partially protrude out of the base wall 31.

Figure 7:
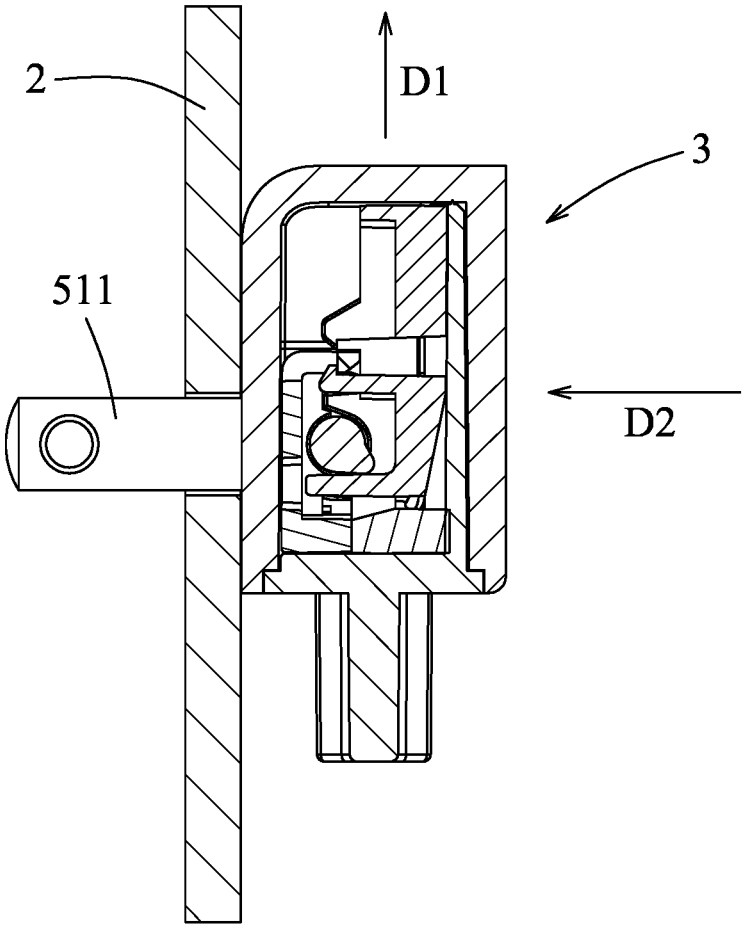
FIG. 7 is a cross-sectional view illustrating a plug-in direction, along which the embodiment is plugged into and unplugged from a plug socket, perpendicular to the mount direction.

Referring to FIG. 7 in combination with FIGS. 5 and 6, when the electrical plug device of the embodiment is intended to be plugged into a plug socket 2, the plug prongs 511 will be flipped along a rotational direction (R) to pivot to the unfolded position, where the plug prongs 511 protrude out of the slots 36 and are inclined with respect to the slot forming wall 32. Then, the electrical plug device can be easily plugged into the plug socket 2 with the plug prongs 511 in the plug-in direction (D2), which is perpendicular to the mount direction (D1). Furthermore, when the electrical plug device is intended to be unplugged from the plug socket 2, a manual force in an unplugging direction opposite to the plug-in direction (D2) will be applied to the electrical plug device to pull the plug prongs 511 out of the plug socket 2.

Referring back to FIGS. 2 and 3, the second positioning part 522 may further include a pair of spaced-apart security blocks 527 opposite to the second hook portion 524 and adjacent to the opening 351 of the receiving space 35. If the cover unit 4 is detached from the housing 3 under misuse or any inadvertent circumstances, the blocks 527 can prevent children from putting their fingers inside the opening 351 and the receiving space 35 to come in contact with the terminals 513 and the plug prongs 511.

The configuration of the plug prongs 511 of the electrical plug device of this embodiment is shown to be designed to comply with specifications of plug sockets in Taiwan, the USA, and Japan. However, the configuration of the plug prongs 511 of the electrical plug device can be varied to comply with specifications of other countries.

In sum, by virtue of the structural arrangement of the housing 3, the cover unit 4 and the plug module 5, both the plug-in direction (D2) and the unplugging direction are perpendicular to the mount direction (D1), and thus, the structural stability of the electrical plug device of the disclosure will not be adversely affected by plugging and unplugging operations. Specifically, with the housing 3 being formed as one-piece, the electrical plug device is difficult to be torn apart even when an excessive manual force is applied thereto.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electrical plug device, comprising:

a housing including a base wall, a slot forming wall peripherally extending from said base wall, an engaging-groove forming wall peripherally extending from said base wall and opposite to said slot forming wall, a pair of opposite side walls peripherally extending from said base wall and each bridging said slot forming wall and said engaging-groove forming wall, and at least one slot formed in said slot forming wall and extending to and meeting said base wall, said slot forming wall, said engaging-groove forming wall and said side walls cooperatively defining a receiving space that is in spatial communication with said at least one slot and that has an opening opposite to said base wall;

a cover unit mounted on said housing and covering said opening; and a plug module mounted to said cover unit, extending into said housing and received in said receiving space, said plug module including a fixing unit mounted to said cover unit, and a plug member fixed to said cover unit by said fixing unit, and including at least one plug prong that is movably disposed in said at least one slot to pivot between a folded position, where said at least one plug prong lies in said at least one slot and has one end extending toward said base wall, and an unfolded position, where said at least one plug prong protrudes out of said at least one slot and is inclined with respect to said slot forming wall.

2. The electrical plug device of claim 1, wherein said plug member further includes a plug prong support connected to said at least one plug prong, said fixing unit including a first positioning part and a second positioning part that interlocks with said first positioning part, said plug prong support being rotatably disposed between said first positioning part and said second positioning part.

3. The electrical plug device of claim 2, wherein said first positioning part has a first hook portion, said second positioning part having a second hook portion interlocking with said first hook portion.

4. The electrical plug device of claim 2, wherein said plug member further includes at least one terminal protruding from said plug prong support and electrically connected to said at least one plug prong, said plug module further including at least one conductor element that is electrically connected to said at least one terminal of said plug member and that extends through said cover unit.

5. The electrical plug device of claim 4, wherein said cover unit includes a base plate covering said opening of said receiving space of said housing, and a tongue plate extending from said base plate into said receiving space, said engaging-groove forming wall of said housing being formed with an engaging groove engaged with said tongue plate of said cover unit.

6. The electrical plug device of claim 5, wherein said cover unit further includes a guide portion extending from said base plate in a direction away from said receiving space, said guide portion being formed with at least one through hole, said conductor element including at least one tubular portion extending into said at least one through hole of said guide portion through said base plate, at least one conductive plate extending from said at least one tubular portion and electrically connected to said at least one terminal, and a barb portion connected to said conductive plate and engaged with said tongue plate of said cover unit.

7. The electrical plug device of claim 6, wherein said tongue plate is formed with at least one guide groove to guide said at least one tubular portion to extend into said at least one through hole.

8. The electrical plug device of claim 7, wherein said at least one slot includes two spaced apart slots form in said slot forming wall, said at least one plug prong including two plug prongs respectively extending in said slots, said at least one terminal including two terminals respectively protruding from two opposite ends of said plug prong support and electrically connected to said plug prongs, said at least one conductor element including two conductor elements respectively and electrically connected to said terminals of said plug member, said at least one through hole including two through holes, said at least one guide groove including two guide grooves for guiding extension of said tubular portions into said through holes.

9. The electrical plug device of claim 8, wherein said first positioning part further includes an engaging portion engaged between said guide grooves, said engaging portion being formed with a first ultrasonic welding line and welded to said tongue plate between said guide grooves.

10. The electrical plug device of claim 5, wherein said base plate of said cover unit has a flange portion formed with a second ultrasonic welding line and welded to said engaging-groove forming wall.

11. The electrical plug device of claim 1, wherein said base wall, said slot forming wall, said engaging-groove forming wall, and said opposite side walls are integrally formed as a single piece structure.

12. The electrical plug device of claim 1, wherein a junction between said base wall and said slot forming wall forms a rounded corner.

13. The electrical plug device of claim 3, wherein said second positioning part further includes a pair of spaced-apart security blocks opposite to said second hook portion and adjacent to said opening of said receiving space.

* * * * *